US009502805B2

(12) United States Patent
Guillanton et al.

(10) Patent No.: US 9,502,805 B2
(45) Date of Patent: Nov. 22, 2016

(54) CONNECTOR FOR MOTOR VEHICLES

(71) Applicant: DELPHI INTERNATIONAL OPERATIONS LUXEMBOURG S.A.R.L., Bascharage (LU)

(72) Inventors: Melanie Guillanton, Maintenon (FR); Erwan Guillanton, Maintenon (FR)

(73) Assignee: Delphi International Operations Luxembourg S.A.R.L., Luxembourg (LU)

( * ) Notice: Subject to any disclaimer, the term of this patent is extended or adjusted under 35 U.S.C. 154(b) by 7 days.

(21) Appl. No.: 14/690,951

(22) Filed: Apr. 20, 2015

(65) Prior Publication Data

US 2015/0311618 A1 Oct. 29, 2015

(30) Foreign Application Priority Data

Apr. 23, 2014 (FR) ..... 14 53658

(51) Int. Cl.

| | |
|---|---|
| ***H01R 13/514*** | (2006.01) |
| ***H01R 13/436*** | (2006.01) |
| ***H01R 13/426*** | (2006.01) |
| ***H01R 13/641*** | (2006.01) |
| ***H01R 43/20*** | (2006.01) |

(52) U.S. Cl.

CPC ..... *H01R 13/436* (2013.01); *H01R 13/426* (2013.01); *H01R 13/4365* (2013.01); *H01R 13/641* (2013.01); *H01R 43/20* (2013.01)

(58) Field of Classification Search

USPC ..... 439/752, 595

See application file for complete search history.

(56) References Cited

U.S. PATENT DOCUMENTS

| | | | | |
|---|---|---|---|---|
| 5,989,066 | A * | 11/1999 | Cox | H01R 13/4365 439/595 |
| 5,993,255 | A * | 11/1999 | Yurko | H01R 13/631 439/364 |
| 6,827,609 | B1 * | 12/2004 | Martin | H01R 13/4365 439/595 |
| 7,063,578 | B2 * | 6/2006 | Goto | H01R 13/4361 439/595 |
| 7,387,545 | B2 * | 6/2008 | Tyler | H01R 13/4365 439/595 |
| 7,670,177 | B2 * | 3/2010 | Myer | H01R 13/4365 439/595 |
| 7,682,180 | B2 * | 3/2010 | Brown | H01R 13/4223 439/352 |
| 2010/0055961 | A1 * | 3/2010 | Martin | H01R 13/4365 439/345 |

FOREIGN PATENT DOCUMENTS

EP 1235306 A2 2/2006

OTHER PUBLICATIONS

French Preliminary Patent Search Report for Application No. FR 1453658, published Dec. 9, 2014.

* cited by examiner

*Primary Examiner* — Tho D Ta

(74) *Attorney, Agent, or Firm* — Robert J. Myers

(57) ABSTRACT

The invention relates to a connector for motor vehicles. By means of the invention the device for assuring the position of the contacts is prevented from being accidentally displaced from its shipping position to its use position. To this end, the device for assuring the position of the contacts is locked in the shipping position against a stop. On insertion of one or more contacts into its respective cavity, a direct interaction between this contact or these contacts and the device for assuring the position of the contacts causes escape from the stop. The device for assuring the position of the contacts can then be displaced from its shipping position to its use position.

3 Claims, 3 Drawing Sheets

CONNECTOR FOR MOTOR VEHICLES

CROSS-REFERENCE TO RELATED APPLICATION

This application claims the benefit under 35 U.S.C. §119 (a) of patent application Ser. No. 14/53,658, filed in France with the Institut National de la Propriété Industrielle (INPI) on Apr. 23, 2014, the entire disclosure of which is hereby incorporated by reference.

TECHNICAL FIELD OF THE INVENTION

The invention relates to the field of connectors for motor vehicles. More particularly, the invention relates to a connector for motor vehicles with a contact-carrying case including at least one cavity to receive a contact and a device for assuring the position of the contacts (also called TPA for "Terminal Position Assurance" or PLR for "Primary Lock Retention").

BACKGROUND OF THE INVENTION

In this type of connector, the device for assuring the position of the contacts is movable between a shipping position and a use position. More specifically, the device for assuring the position of the contacts should remain in the open position, or shipping position, until the connector is housed in the cavities intended for this purpose of the electrical contacts, generally attached to the end of a cable. When the contacts are correctly positioned in their respective cavities, the device for assuring the position of the contacts should be displaceable into a closed position, or use position. If at least one contact remains incorrectly inserted in its cavity, the primary locking means allowing this contact to be locked in its cavity prevents the displacement of the device for assuring the position of the contacts. The operator in charge of the mounting of the contacts is thus warned of the incorrect insertion of at least one contact.

To increase the productivity of the operation of insertion of the contacts into the connector, the connector should be kept with the device for assuring the position of the contacts in the shipping position, until this operation takes place.

However, a common problem is, due to the fact that during packaging, shipping or other handling operations, the device for assuring the position of the contacts is accidentally moved into the use position before insertion of the contacts into the connector has been started. An object of the invention is to reduce the risk of encountering this problem.

BRIEF SUMMARY OF THE INVENTION

In accordance with an embodiment of the invention, a fuse-carrying connector is provided. In this case, the device for assuring the position of the contact advantageously has a portion extending at least partially in the cavity of an electrical supply contact. Indeed, in this example of a fuse-carrying connector, for this to be functional, such cavities will always necessarily be provided with an electrical supply contact.

In accordance with another embodiment, a process for mounting a connector for motor vehicles is provided. The process comprises the provision of a contact-carrying case, including at least one cavity and provided with a device, movable between a shipping position and a use position, for assuring the position of the contacts. In accordance with this process, a contact is inserted in the cavity. The contact then retracts a portion of the device for assuring the position of the contact, extending at least partially in the cavity, thus releasing the device for assuring the position of the contact from an abutment against which it was stopped. After this release of the device for assuring the position of the contact, the device can be made to slide to assure the position of the contact, from the shipping position to the use position.

Other characteristics and advantages of the invention will become apparent on reading the detailed description and the attached drawings.

BRIEF DESCRIPTION OF THE SEVERAL VIEWS OF THE DRAWING

The present invention will now be described, by way of example with reference to the accompanying drawings, in which.

In these figures, the same references are used to designate identical or similar elements.

DETAILED DESCRIPTION OF THE INVENTION

The connector and the process described herein address the problem of the device for assuring the position of the contacts being accidentally displaced into the use position before the operation of insertion of the contacts into the connector has been started. This aim is at least partially achieved with a connector of the type described above in which, in the shipping position, the device for assuring the position of the contacts has a portion extending at least partially in the cavity, stopped against an abutment of the case. The device for assuring the position of the contact being completely stopped against this abutment, it cannot be inadvertently displaced from its shipping position towards its use position. In fact, it can only be displaced from its shipping position towards its use position if a contact is introduced into the cavity in which the portion of the device for assuring the position of the contacts at least partially extends.

It is known to provide cavities for contacts matching the dimensions of the contacts to limit the play around the contacts and thus make reliable coupling with the complementary contacts of a mating connector or against another. The insertion of a contact into the cavity therefore causes a displacement of the portion extending in the cavity and releases this from the abutment in the case. In other words, the device for assuring the position of the contact is released from this stop due to its interaction with a contact, when this is inserted into the cavity.

For example, the device for assuring the position of the contact includes a retractable tooth projecting into the cavity when the device for assuring the position of the contact is in the shipping position. This tooth can also project into the cavity when the device for assuring the position of the contact is in the use position. In this case, the retractable tooth can be housed in an opening or window of the contact when the device for assuring the position of the contact is in the use position. Thus, if the retractable tooth is carried by a flexible arm, this can be in the rest position, i.e. unstressed, whether this be in the shipping position or in the use position of the device for assuring the position of the contact. This avoids any creep over time of the material (plastic) from which the device for assuring the position of the contact is made.

The invention is illustrated below by means of a particular example embodiment of a connector 1. In accordance with this example, the connector 1 described is a fuse-carrying connector.

Figure 1:
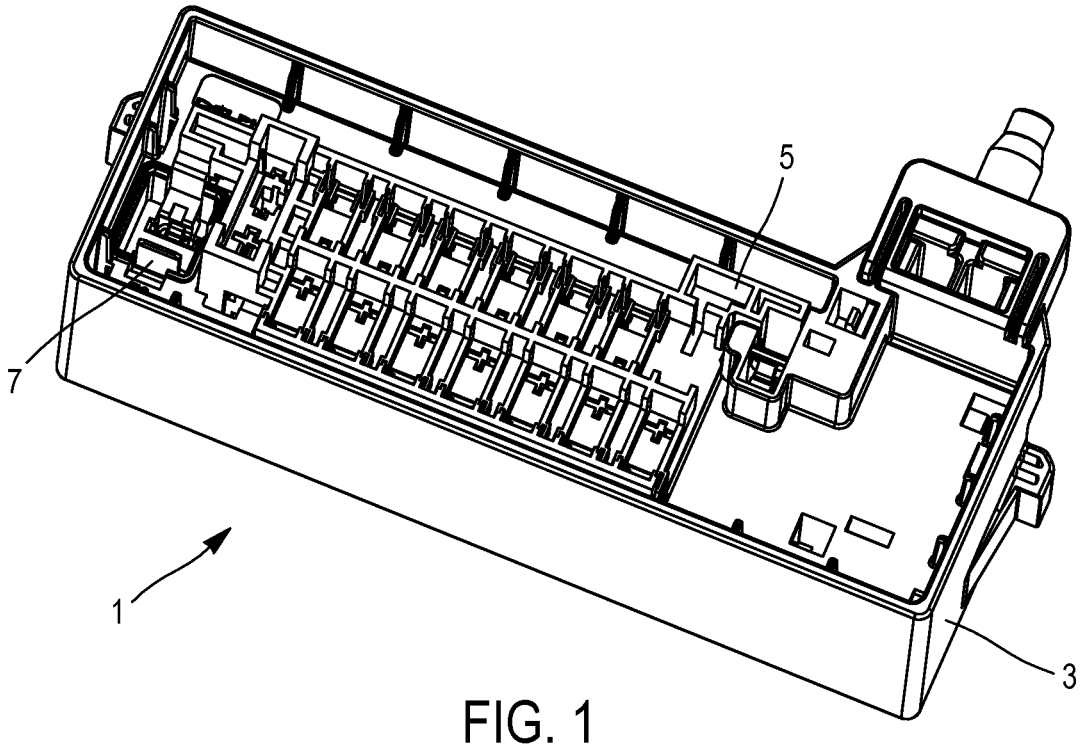
FIG. 1 shows diagrammatically in perspective an example embodiment of a connector in accordance with the invention.
Figure 2:
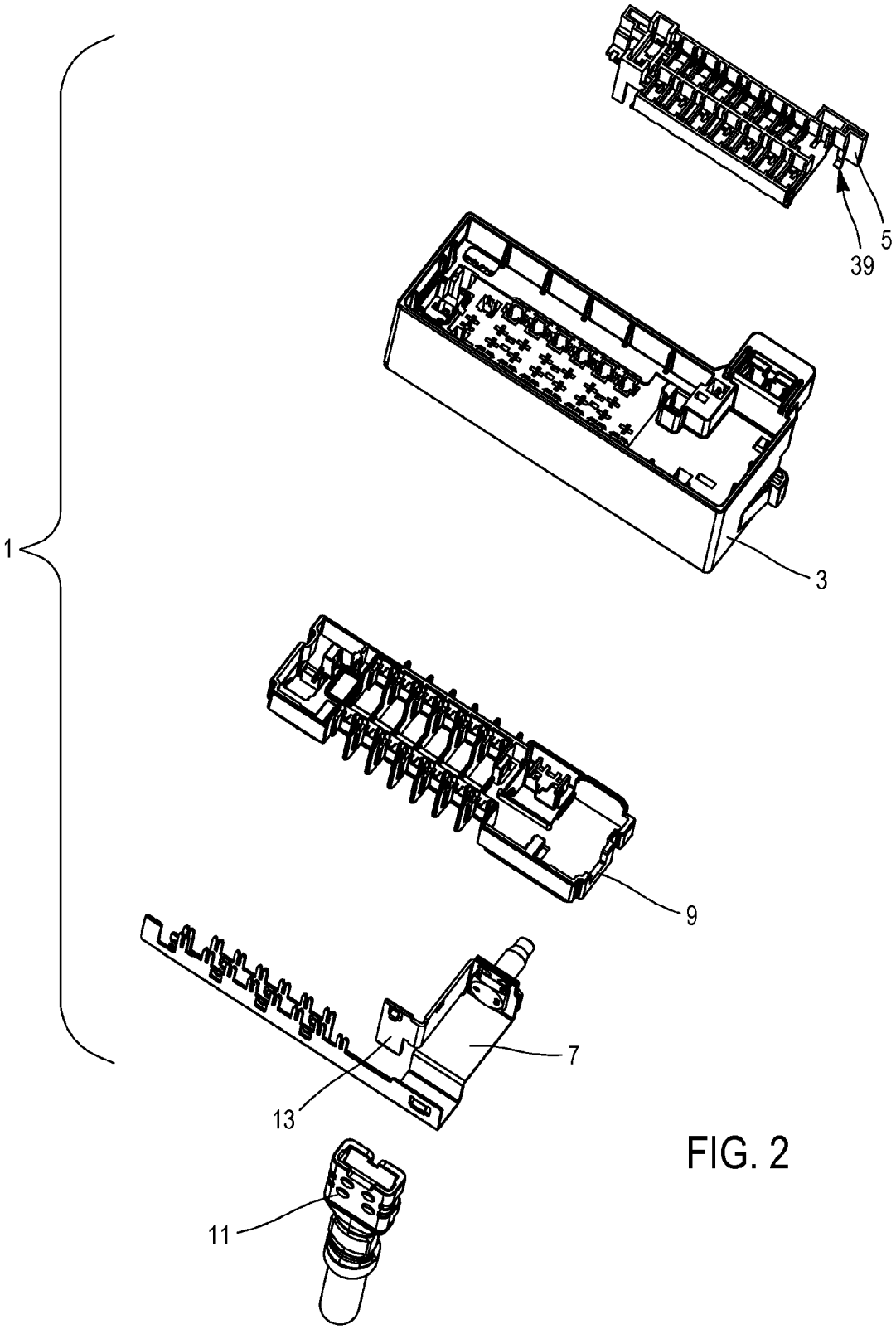
FIG. 2 shows diagrammatically in perspective, in exploded manner, the connector of FIG. 1.

As shown in FIGS. 1 and 2, it includes a case 3, a device 5 for assuring the position of the contacts, also called "Terminal Position Assurance (TPA) or "Primary Lock Retention" (PLR) device and hereinafter referred to as a TPA device, a bus bar 7 (also called a busbar) and secondary locking means 9. Among the contacts housed in the case 3 is an electrical supply contact 11, the only one shown in the figures.

The case 3, the TPA device 5 and the secondary locking means 9 are formed of an electrically insulating material (plastic material). The contacts and the bus bar 7 are electrically conductive (e.g. copper alloy).

The electrical supply contact 11 is a female contact suitable for coupling with a terminal 13 of the bus bar 7 and for distributing current to the set of fuses (not shown) mounted on the connector 1.

Figure 3:
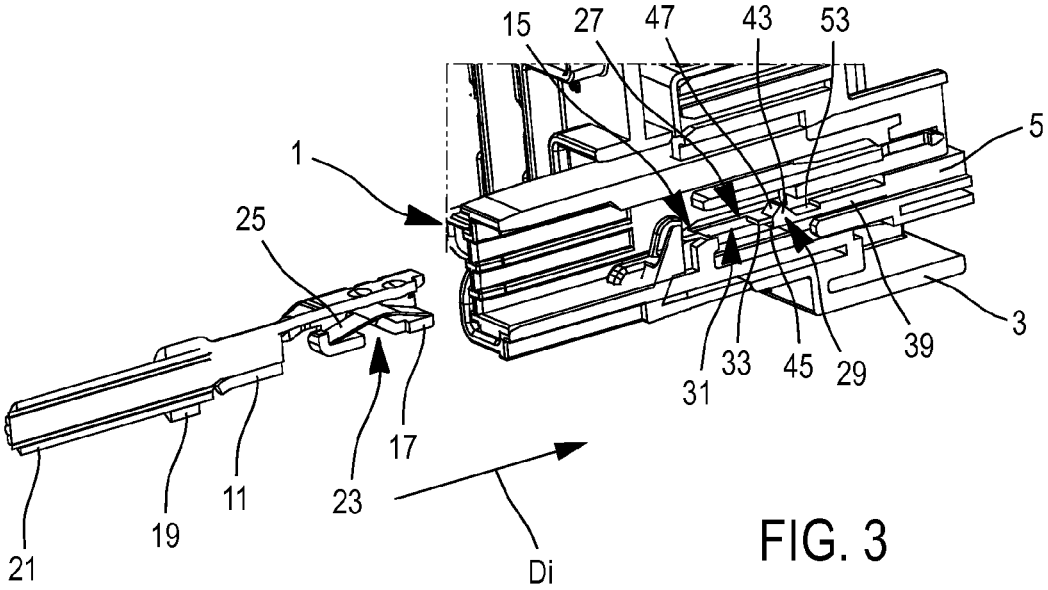
FIG. 3 shows diagrammatically in section a cavity of the connector of FIGS. 1 and 2.

As shown in FIG. 3, the contact 11 is housed in a cavity 15 of the case 3. It includes a cage 17 and a crimping end 19 to which is attached the end of a cable 21. The contact 11 is made by stamping, punching and bending of a blank. In the cage 17, over an opening 23, is placed a spring contact strip 25.

The cavity 15 is essentially defined by four walls at right-angles in pairs. One of them which we shall call a lower wall 27 includes two openings: an upstream opening 29 and a downstream opening 31 separated by a cross-piece 33.

Figure 4:
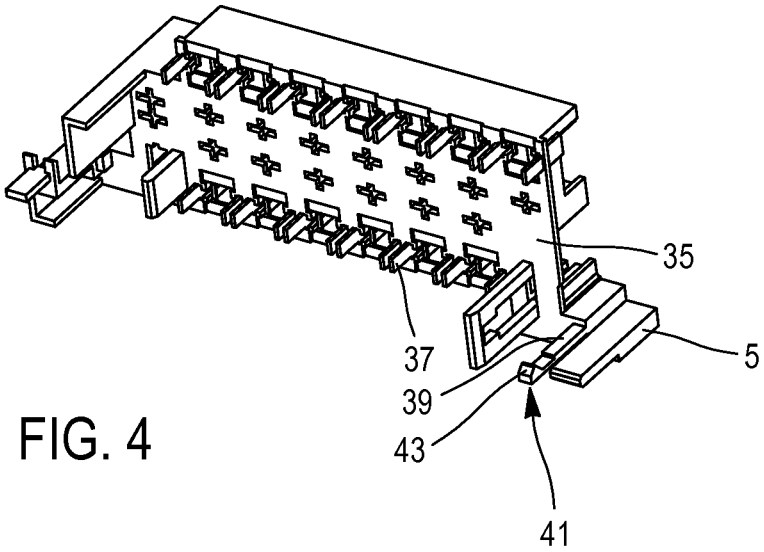
FIG. 4 shows diagrammatically in perspective the device for assuring the position of the contacts of the connector of FIGS. 1 and 2.

Returning to the TPA device 5, shown alone in FIG. 4. This includes a plate 35 perpendicularly to which extend legs intended to come behind retaining latches (not shown) formed in one piece with the case 3 and assuring the primary locking of the contacts receiving fuse pins. If at least one of these contacts is not correctly positioned in its cavity, the corresponding retaining latch locks one of the legs 37 and prevents the displacement of the TPA device 5, from its shipping position towards its use position.

The TPA device 5 also includes a flexible arm 39 extending perpendicularly to the plate 35, from this. The flexible arm 39 includes a free end 41 on which is arranged a tooth 43. The tooth 43 forms a portion of the flexible arm 39.

Figure 5:
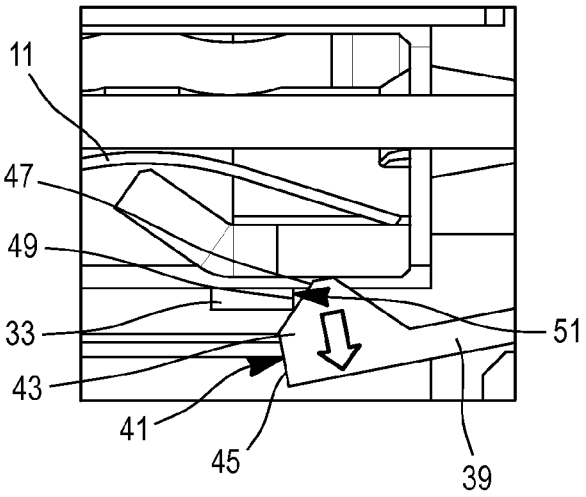
FIG. 5 shows diagrammatically, in section, a cavity in which a contact is inserted, the device for assuring the position of the contacts being in the shipping position, but displaced by the contact.
Figure 6:
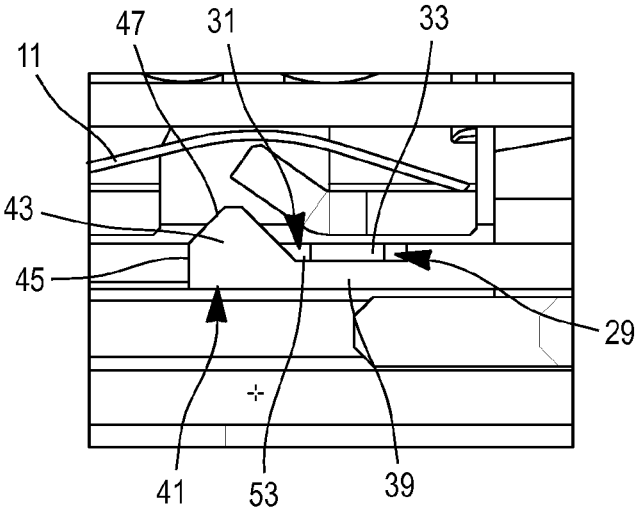
FIG. 6 shows in similar manner to FIG. 5 the device for assuring the position of the contacts 5 in the use position.

More precisely, as shown in FIGS. 3, 5 and 6, the free end 41 includes a stop surface 45 perpendicular to the longitudinal direction of the flexible arm 39, i.e. perpendicular to the displacement of the TPA device 5 from its shipping position towards its use position (This displacement takes place in the direction opposite to the insertion direction Di of the electrical supply contact 11 into its cavity 15).

The free end 41 also includes, adjacent to the stop surface 45, on the tooth 43, a sliding surface 47 essentially forming an obtuse angle with the insertion direction Di of the electrical supply contact 11 into its cavity 15. The tooth 43 extends into the cavity 15, above the level of the surface of the lower wall 27.

Before the introduction of the contact 11 into the cavity 15, in the position of the TPA device 5 corresponding to its shipping position, the tooth 43 is housed in the upstream opening 29 and the flexible arm 39 is therefore not bent. It is at rest and cannot be deformed in the course of time.

On the introduction of the contact 11 into the cavity 15, the latter contact interferes with the tooth 43, more particularly with the sliding surface 47. Thus, the sliding surface 47 facilitates the introduction of the contact 11 into the cavity 15 and allows the tooth 43 to be retracted on this introduction.

Another sliding surface is provided adjacent to the sliding surface 47, on the tooth 43 to facilitate the displacement of the TPA device 5 from its use position towards its shipping position, e.g. for unmounting. The contact 11 can thus be placed correctly in the cavity 15.

As shown in FIG. 5, the cross-piece 33 presents an abutment 49 with an abutment surface 51, perpendicular to the longitudinal direction of the flexible arm 39 (in the rest position), i.e. perpendicular to the displacement of the device for assuring the position of the contacts five from its shipping position towards its use position. This abutment surface 51 forms a complete stop for the TPA device 5.

On the introduction of the contact 11 into the cavity 15, the displacement of the tooth 43 out of the cavity 15 by the contact 11 allows the stop surface 45 to escape the abutment surface 51. This displacement of the tooth 43 causes elastic bending of the flexible arm 39. It is then the sliding surface 47 which can come into contact with the abutment surface 51 and the TPA device 5 can be easily displaced from its shipping position towards its use position. The free end 41 of the flexible arm 39 therefore presents a sort of complete stop (stop surface 45) and a retractable stop (sliding surface 47) superimposed the one on the other, the passage from the one to the other taking place by bending of the flexible arm 39 on introduction of the contact 11 into the cavity 15.

Once in the use position of the TPA device 5, the tooth 43 enters the downstream opening 31 in which it is housed. In addition, a notch 53 allows the flexible arm 39 to pass under the cross-piece 33, without abutting against this. The flexible arm 39 is therefore not bent. It is at rest and cannot be deformed in the course of time.

For unmounting, the TPA device 5 is displaced from its use position to its shipping position. As mentioned above, the other sliding surface, adjacent to the sliding surface 47, facilitates the displacement of the tooth 43 out of the cavity 15 and under the cross-piece 33.

The invention claimed is:

1. A connector for motor vehicles, comprising:

a contact-carrying case having a cavity configured to receive a contact; and a terminal position assurance (TPA) device configured to assure the position of the contact in the cavity and movable between a shipping position and a use position, wherein the TPA device includes a retractable tooth projecting into the cavity in the shipping position and in the use position, wherein the TPA device is stopped against an abutment of the case when in the shipping position, and wherein the retractable tooth is housed in an opening of the contact when in the use position.

2. The connector according to claim 1, wherein the TPA device is released from the abutment due to an interaction of the contact with the TPA device, on insertion of the contact into the cavity.

3. The connector according to claim 1, wherein the retractable tooth is carried by a flexible arm which is in a rest position, whether this is in the shipping position or in the use position of the TPA device.

* * * * *